United States Patent [19]

Liu

[11] Patent Number: 4,609,576

[45] Date of Patent: Sep. 2, 1986

[54] ARTIFICIAL CHRISTMAS TREES

[75] Inventor: Hon Liu, Hong Kong, Hong Kong

[73] Assignee: United Chinese Plastics Products Co. Ltd., Kowloon, Hong Kong

[21] Appl. No.: 671,522

[22] Filed: Nov. 14, 1984

[30] Foreign Application Priority Data

Jun. 20, 1984 [GB] United Kingdom ..... 8415719

[51] Int. Cl.[4] ..... A47G 33/06

[52] U.S. Cl. ..... 428/18; 57/203; 140/149

[58] Field of Search ..... 428/18; 57/203; 140/149; 156/61

[56] References Cited

U.S. PATENT DOCUMENTS

| | | | |
|---|---|---|---|
| 3,791,421 | 2/1974 | Barrett | 140/149 |
| 3,819,457 | 6/1974 | Mottel | 428/18 X |
| 3,846,212 | 11/1974 | Rodermund et al. | 428/18 X |
| 4,207,928 | 6/1980 | Pershin et al. | 140/149 X |
| 4,219,594 | 8/1980 | Herrara-Cabello | 428/18 |
| 4,513,564 | 4/1985 | Seehawer | 57/203 X |
| 4,562,609 | 1/1986 | de Ruyeter | 15/171 |

*Primary Examiner*—Henry F. Epstein
*Attorney, Agent, or Firm*—Townsend and Townsend

[57] ABSTRACT

Artificial Christmas trees have been formed by sandwiching one or more thin strips of plastics sheeting, whose side edges have been severed by a very large number of closely spaced transverse cuts so as to give transverse elements simulating the pine needles, between a pair of wires approximately at the longitudinal center line of the strip. The resulting structure is cut to a length of two twigs and joined at its center to a main branch formed, for example, by twisting a pair of larger wires. A full branch is formed by providing a number of such twigs spaced along the length of the branch. In a branch of an artificial Christmas tree according to the invention a length to be formed into a pair of twigs is formed by twisting the composite structure at the center of its length relative the two ends forming twists of opposite directions on either side of the center. As a result the simulated pine needles trapped between the twisted wires on each half are oriented towards the outer ends or what will be the tips of the twigs and the simulation of the resulting artificial Christmas tree to a real tree is enhanced.

6 Claims, 16 Drawing Figures

ARTIFICIAL CHRISTMAS TREES

This invention relates to artificial Christmas trees and to ornamental decorations which include branches and the like of an artificial or simulated Christmas tree.

BACKGROUND OF THE INVENTION

Early attempts at producing artificial Christmas trees involved moulding individual twigs in synthetic plastics material so as to simulate the individual pine needles and providing some form of plug and socket connection for joining these individual twigs on to moulded branches. Only very poor simulation of a Christmas tree was provided in that way.

A far more accurate simulation of the pine needles of a Christmas tree is achieved by sandwiching one or more thin strips of plastics sheeting, whose side edges have been severed by a very large number of closely spaced transverse cuts so as to give transverse elements simulating the pine needles, between a pair of wires approximately at the longitudinal centre line of the sandwich and twisting the resulting composite structure from one end to the other. These individual transverse elements closely simulate pine needles and the result is a length of branch or twig which can then be cut to the desired length, and joined at its centre to a main branch formed, for example, by twisting a pair of larger wires. A full branch is formed by providing a number of such twigs spaced along the length of the branch.

In a natural Christmas tree the needles are not strictly transverse to the length of the twig but are inclined outwardly from the stem of the twig and towards the end or tip of the twig. The act of twisting the plastics sheeting between the two wires gives precisely this inclined effect to the transverse elements. Unfortunately this means however that when a length is bent in the middle to provide the pair of twigs held by the twisted wires forming the branch, one twig is an accurate simulation with the simulated pine needles inclined towards the tip of the twig but the other twig has the simulated pine needles oriented away from the tip. Naturally this spoils the accuracy of simulation.

In the branch of an artificial Christmas tree according to the invention a length to be formed into a pair of twigs is formed by twisting the composite structure at the centre of the length relative the two ends. As a result the simulated pine needles on each half are oriented towards the outer ends or what will be the tips of the twigs and the simulation of the resulting artificial Christmas tree to a real tree is enhanced.

BRIEF SUMMARY OF THE INVENTION

Therefore, according to the invention in one aspect there is provided an artificial Christmas tree branch comprising a main stem formed by twisting a number of wires around one another length-wise and trapping at spaced intervals twig pairs, each twig pair having been formed by twisting at the centre of its length relative its ends, a composite structure made up by sandwiching at least one layer of plastics sheeting whose side edges have been severed by a large number of transverse cuts and at least two wires, the twig pairs being held trapped between the wires forming the main stem at approximately the centres of their length.

The invention also extends in another aspect to a method of making simulated twigs for a Christmas tree in which at least one strip of synthetic plastics sheeting whose edges have been severed by a large number of transverse cuts is sandwiched between at least two wires positioned approximately at the longitudinal centre line of the sandwich, the sandwich is fixed at two points approximately spaced apart by the combined length of two twigs whilst at its approximate centre between the two fixed points, the sandwich is rotated to twist up the wires along the length of the sandwich in opposite senses on either side of that centre, the sandwich is advanced by an amount corresponding approximately to the combined length of two twigs and the twisting repeated, and the resulting continuous length is thereafter severed at points corresponding to the fixed points to give twig pairs which can be held at the approximate centre to simulate a pair of twigs on a branch.

These resulting twigs can then be incorporated into branches as described above by trapping them between a number of wires twisted about one another lengthwise to form a main stem of a branch. Further the invention extends to an artificial Christmas tree comprising a number of branches formed in this way which are arranged about an upright trunk.

The method of making the twig pair as described above can be very simple and quick and does not require significant changes in the production of a Christmas tree over and above the existing way of making the simulated twigs where a continuous length is formed from one or more strips of plastics materials and pairs of wires which is twisted up in a single sense as it is continuously formed. In the method of the invention, by contrast, the length which is formed is formed step-wise with alternate sections twisted in opposite senses so that the simulated needles are inclined in opposite directions in each adjacent portion. Thereafter this length is cut at fixed points to give the twig pairs where the needles in effect are inclined towards what will be the tips of each twig.

Although the twig pairs formed according to the invention will normally be used in the manufacture of complete Christmas trees they could equally be used in the formation of other types of Christmas decoration which includes twigs or branches of a simulated Christmas tree.

According to one embodiment of the invention the composite structure or sandwich which is twisted is constituted by two wide strips, one of a lighter green colour and one of a darker green colour to simulate the actual pine needles, and a narrow central strip of a brown colour which may also contain short cuts along the side edges to simulate the stem of the twig.

This is not essential however and different effects can be produced by different numbers and sizes of strips and different colours. Thus excellent simulation can be achieved by using say three strips to simulate the pine needles which are of differing widths to produce a degree of variation in the lengths of the simulated pine needles and one or more narrow central strips to simulate the stem. In this embodiment say three strips of differing widths can be used, i.e. a narrower strip, an intermediate strip and a wider strip with the cuts from the edges of each strip extending evenly from the side edges to the longitudinal centre of each strip.

However, according to another aspect of the invention one can reduce the number of differing materials required by providing a narrow strip and one wider strip in which the cuts are longer from one side edge than from the other side edge. Then a composite structure can be built up using the narrow strip and two layers of the wider strip laid assymetrically, one layer being inverted 180° relative the other layer, so providing cuts and eventually simulated pipe needles after twisting up of three differing lengths on either longitudinal side of the longitudinal centre line of the sandwich.

The apparatus for making the twig pairs according to the invention can comprise a pair of stationary clamps spaced apart by an amount equal to the overall length of a pair of twigs, a central clamp, means for opening and closing the clamps, means for rotating the central clamp when all the clamps are closed, feed means for advancing a continuous length of the said sandwich past the clamps step-wise, the length being advanced by an amount corresponding to the overall length of a pair of twigs each time the clamps open, and cutting means for severing the twisted sandwich at approximately the points where the stationary clamps have gripped the sandwich.

According to one embodiment of the invention the rotatable clamp comprises a pair of rings joined to one another in such a manner that there is a limited angle of rotational freedom, one ring being rotatably driven and the other being subject to a drag force hindering its rotation, and grippers movable between a forward gripping position and a retracted open position as the two rings rotate relative one another between one and other limits of rotational freedom.

In this embodiment one ring may have a pair of opposed circular slots through which pins attached to the other ring extend to give that limited angle of rotational freedom. The grippers in turn can then comprise a pair of pivotably linked arms joined at one end to the pins and at the other end to the ring provided with the slots, relative rotation of the rings to one limit causing the arms to abut one another near the centre of the rings and relative rotation to the other limit retracting the arms away from one another.

DESCRIPTION OF THE DRAWINGS

The invention will now be described by way of example with reference to the accompanying drawings, in which.

DESCRIPTION OF THE PREFERRED EMBODIMENT

Figure 6:
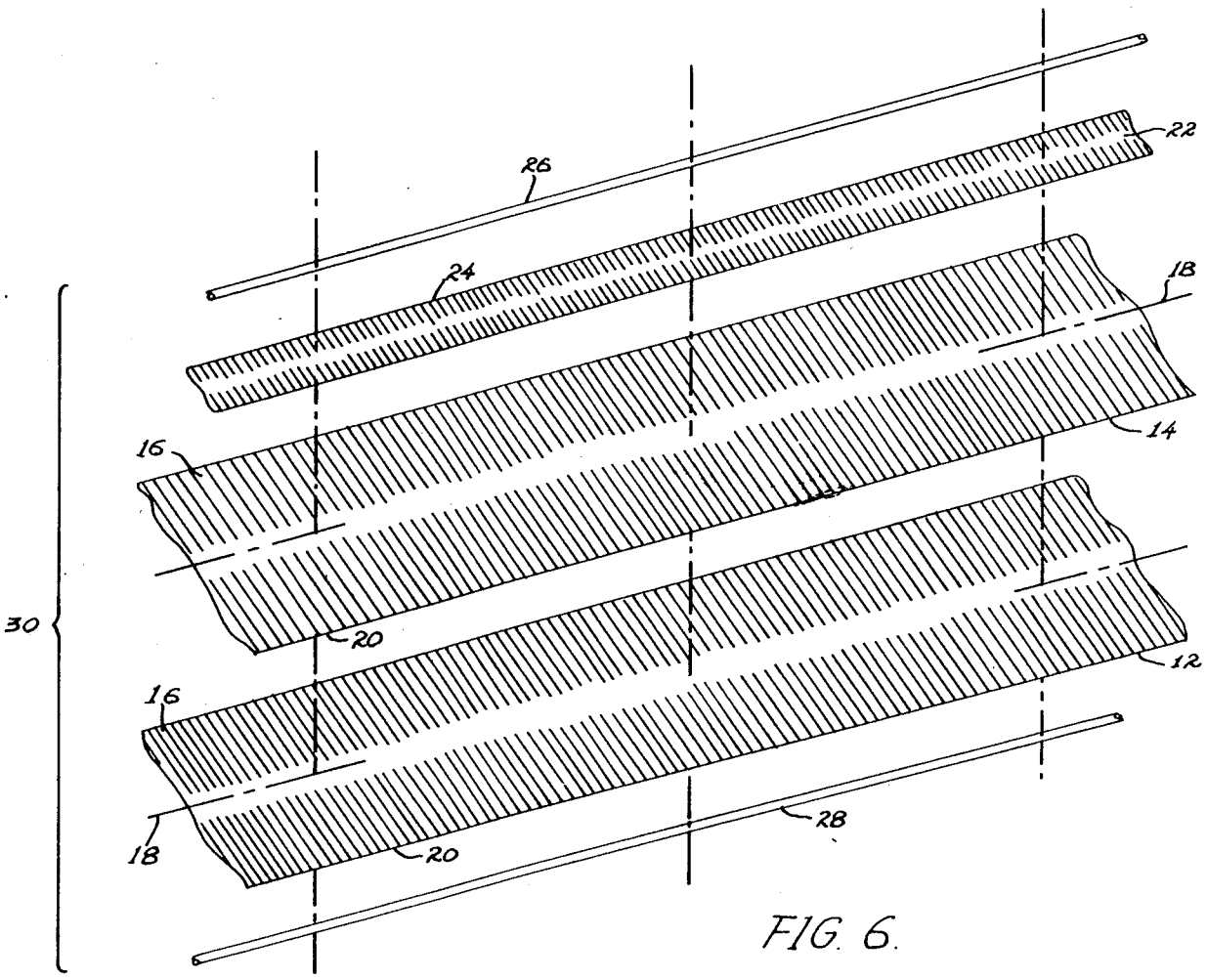
FIG. 6 is a diagram showing the parts of a sandwich to be twisted to produce twigs in a manner according to the invention.

Referring first to FIG. 6 this illustrates the components used in making a simulated Christmas tree twig. A pair of plastics strips 12 and 14, e.g. of polypropylene film, are each provided with a very large number of transverse cuts or slits 16 extending from the side edges to near to the longitudinal centre line 18 of the strips. The cuts 16 do not however extend across that centre line. The cuts are very closely positioned so as to be spaced about 1 mm apart and the resulting elements 20 therefore simulate the pine needles in a real tree. Preferably two strips are provided, one can be of a lighter green colour and the other a darker green colour.

Superimposed over the strips 12 and 14 is a much narrower plastics strip 22 preferably of brown colour to simulate the stem of a twig. This also has a large number of cuts 24 similar to the cuts 16. This strip 22 is designed to simulate the central stem of the twig when the whole structure is twisted.

Finally a pair of thin wires 26 and 28 are provided one on either side of the structure built up by superimposing three strips 12, 14 and 22 so as to sandwich those strips between the wires.

Figure 1:
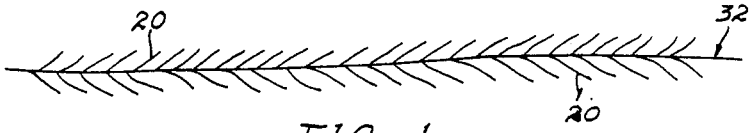
FIG. 1 is a diagram illustrating the appearance of a conventional length of twisted composite structure used to produce twigs.

When, as in the conventional production of artificial Christmas trees, that resulting structure 30 is twisted about its longitudinal axis, the two wires 26 and 28 coil around one another trapping the strips 12, 14 and 22 with the elements 20 extending outwardly. The coiling effect of the two wires, however, causes the elements 22 not to extend transversely out from the coiled wires but to be inclined. FIG. 1 is a diagram showing how the elements 20 are all inclined in the same sense towards one end of the resulting length 32. When that length 32 is severed into shorter lengths corresponding to a pair of twigs and held at the centre, the resulting twig pair is as shown diagrammatically in FIG. 4. As can be seen the left-hand twig 34 has the needles correctly oriented towards the tip, whilst the right-hand twig has them oriented away from the tip which does not give an accurate simulation of a real Christmas tree.

Figure 2:
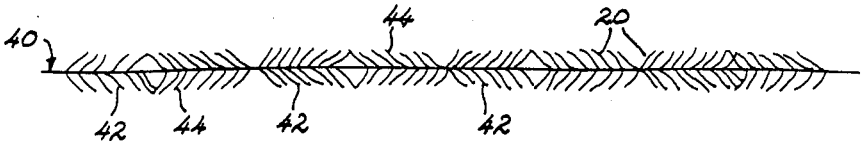
FIG. 2 is a diagram similar to FIG. 1 illustrating the orientation of the simulated needles in a length produced according to the invention.
Figure 4:
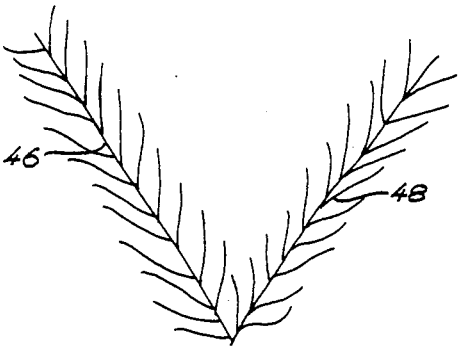
FIG. 4 is an enlarged diagram illustrating one twig pair according to the invention.

By contrast the invention aims to produce a length 40 of twig pairs as shown in FIG. 2. Along this length there are alternating sections 42 and 44 where the wires 26 and 28 have been twisted in opposite senses lengthwise of the length 40. As a result it will be noted that the elements 20 simulating the needles are inclined in opposite directions when the sections 42 and 44 are compared. When that length 40 is severed into lengths corresponding to a twig pair as shown in FIG. 4, the resulting twig pair has a left-hand twig 46 and a right-hand twig 48 where the needles are in each case oriented towards the tip. As a result such twig pairs are a more accurate simulation of a Christmas tree than are the twigs 34 and 36 shown in FIG. 3.

Figure 3:
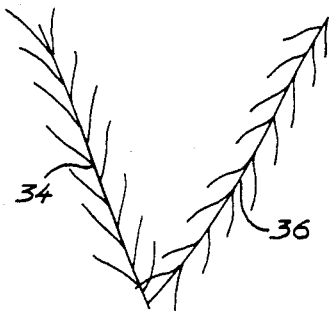
FIG. 3 is an enlarged diagram illustrating a twig pair formed from the twisted composite structure shown in FIG. 1.
Figure 5:
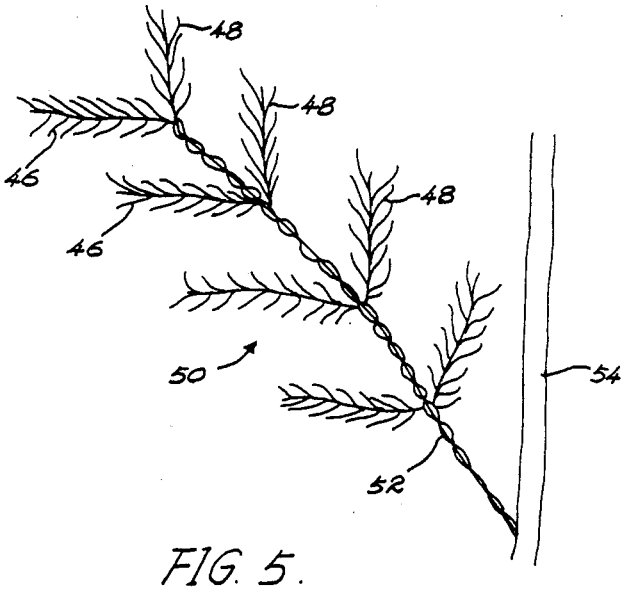
FIG. 5 is a diagram of a part of an artificial Christmas tree where twig pairs as shown in FIG. 4 are made up into branches and in turn assembled to form a Christmas tree.

The twig pairs 46 and 48 shown in FIG. 4 can be made into branches 50 as shown in FIG. 5 where the twig pairs are held trapped at their approximate centre points along their lengths by a pair of twisted wires 52. These wires are of larger diameter than the wires 26 and 28 and this manner of making branches using twig pairs as shown in FIG. 3 is already conventional. Thereafter, to make a tree, the number of branches 50 are assembled in the appropriate orientations around a central upright trunk 54. Again this is conventional and any fuller description is believed not necessary.

Figures 9, 10:
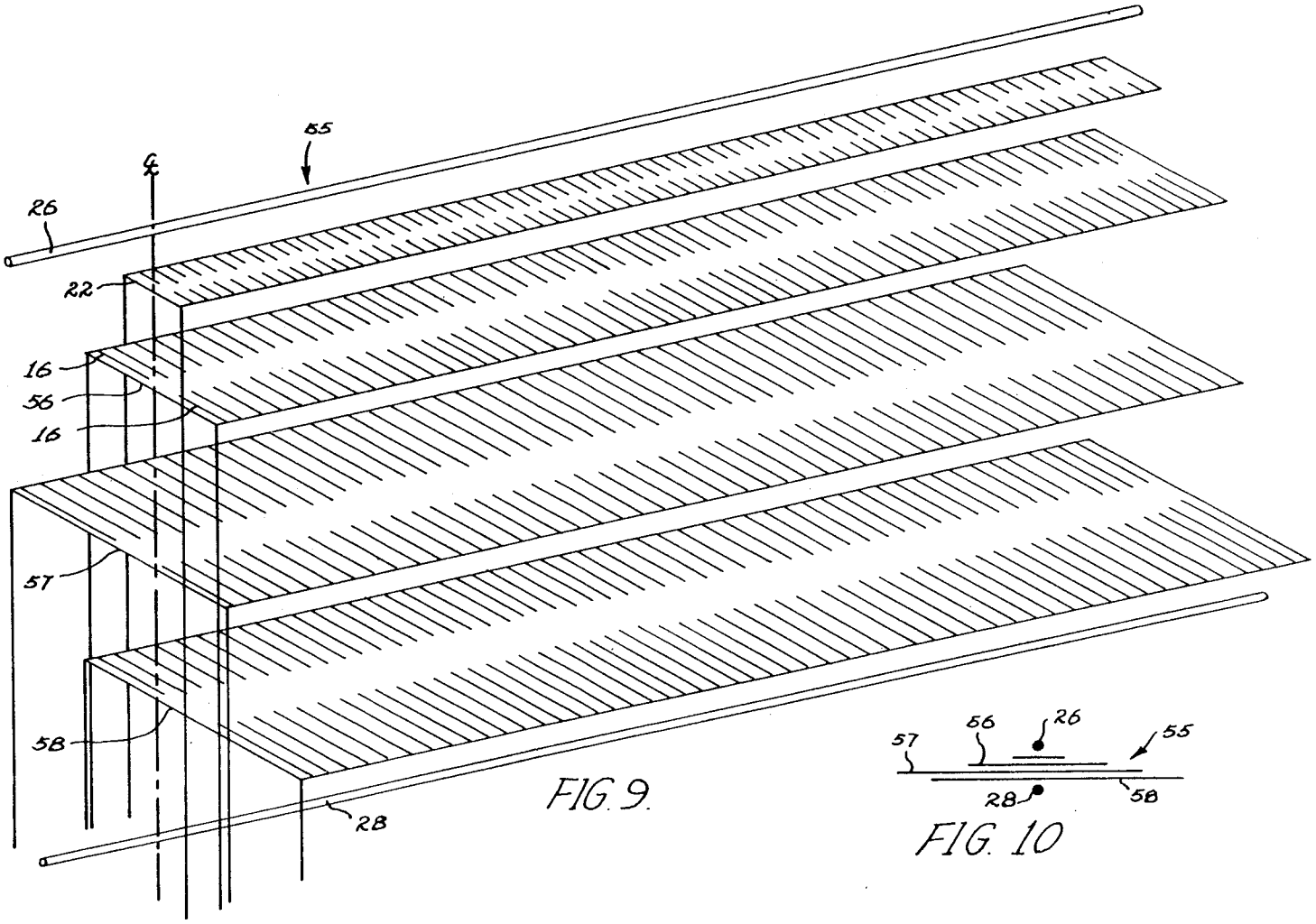
FIG. 9 is a diagram similar to FIG. 6 showing the parts of a sandwich of an alternative embodiment.
FIG. 10 is a cross-sectional diagram of the alternative embodiment of FIG. 9 illustrating the positioning of the parts of the sandwich before twisting.

FIGS. 9 and 10 show an alternative form of composite structure 55 which can be twisted up as described above. The structure includes the narrow strip 22 of brown colour and the two thin wires 26 and 28. It also includes however an intermediate width green strip 56 with cuts 16 extending equally from each side edge and a pair of wider green strips 57 and 58. These strips are identical to one another but they are laid in the structure 55 with one inverted 180° relative the other. Also the strips 57 and 58 are laid so that they are displaced oppositely from one another from the longitudinal centre line of the structure 55, the wires 26 and 28 being in line with the non cut central portions of each strip 22, 56, 57 and 58. The strips 57 and 58 have cuts 16 but the cuts from one side edge are longer or deeper than those from the opposite side edge. In this way, as can best be gauged from FIG. 10, a range of depths of cuts so giving once the structure is twisted up a range of lengths of simulated pine needles.

In order to keep the composite structures 30 and 55 correctly aligned before twisting, the layers can be spot welded at intervals by a suitable plastics welding.

Figure 7:
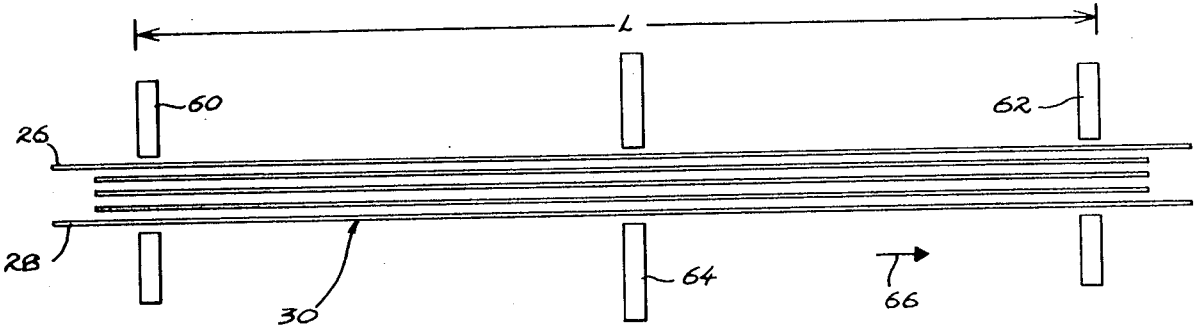
FIGS. 7 and 8 are diagrams illustrating the way in which the composite sandwich shown in FIG. 5 is twisted to make twig pairs according to the invention.
Figure 8:
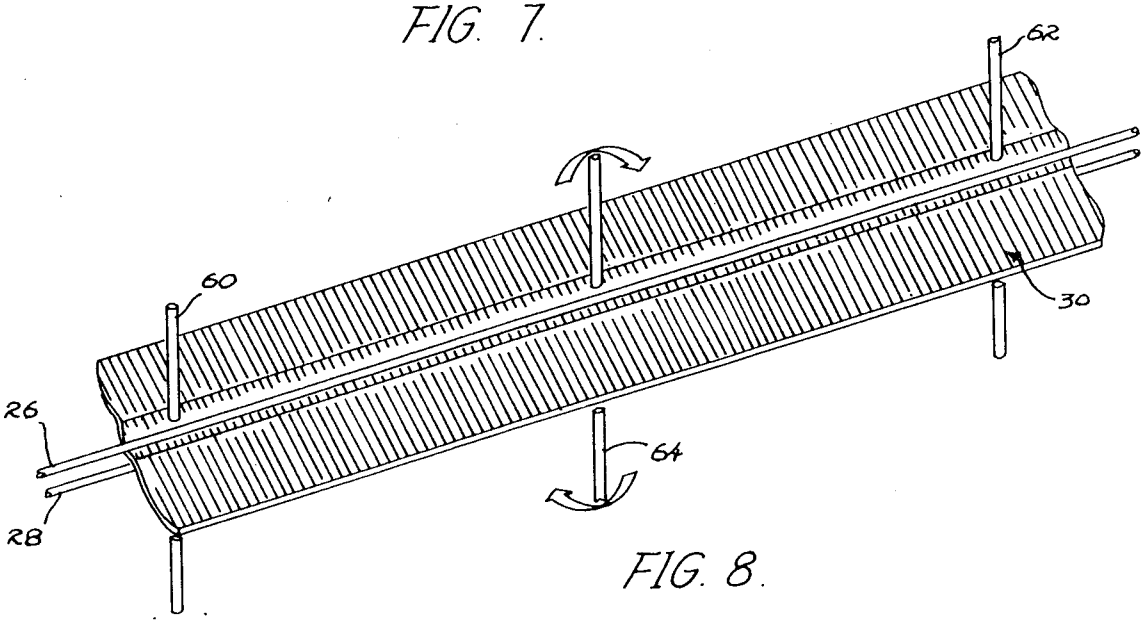

FIGS. 7 and 8 show diagrammatically the manner in which the length 40 shown in FIG. 2 can be formed. A continuous sandwich or composite structure 30 or 55 is formed as described in FIG. 6 or FIGS. 9 and 10 and grippers 60 and 62 are designed to trap and fix the structure at a spacing L corresponding to the total length of two twigs 46 and 48. For simplicity hereinafter reference will be made only to the structure 30. At the approximate centre between the two grippers 60 and 62 a central rotating gripper 64 holds the structure 30 and is rotated for example in the sense shown in FIG. 8 so as to twist up the wires 26 and 28 and form a pair of sections 42 and 44. Then the grippers 60 to 64 release their hold and the composite structure 30 is advanced in the direction of the arrow 66 by an amount L and the process repeated. This cycle continues step-wise to produce an endless length 40. Thereafter, as described in connection with FIGS. 2 and 4, that length 40 is severed at points corresponding to those where the grippers 60 and 62 have held the structure to give the twig pairs 46 and 48 which are thereafter assembled to give branches by being held at centre points corresponding approximately to the points where the gripper 64 held the structure 30.

FIGS. 11 to 16 show in more detail the apparatus used to twist up the composite structure 30 in the manner described in connection with FIGS. 7 and 8.

Figure 11:
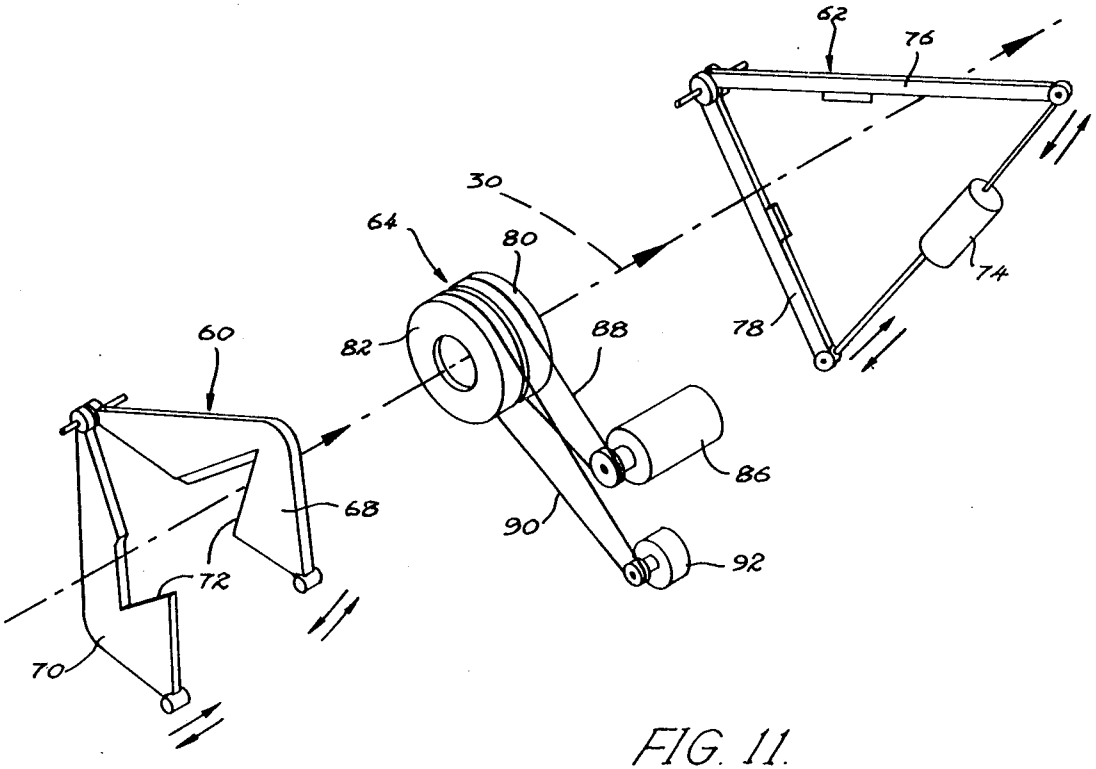
FIG. 11 is a diagrammatic view of the apparatus used to twist the composite structure.

Referring to FIG. 11 the grippers 60 and 62 include a pair of hinged arms 68 and 70 each of which has, in its surface facing the other, a V-shaped notch 72. When these arms are overlapped the composite structure can be trapped and securely held between the apices of the two V-shaped notches. The opening and closing of these arms 68 and 70 is controlled by, for example, a pneumatic or hydraulic actuator 74 extending between a pair of links 76 and 78 joined respectively to the arms 68 and 70.

For the sake of simplicity it will be noted in the left-hand gripper 60 shown in FIG. 11, has only the two arms 68 and 70 whilst the right-hand gripper 62 has only the links 76 and 78 and the actuator 74 shown. In practice each gripper 60 and 62 contains the full combination of both parts shown in FIG. 11.

Figure 14:
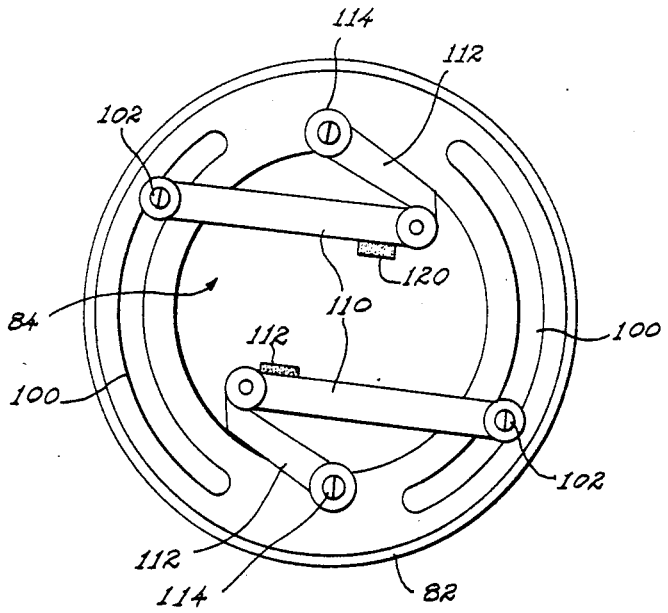
FIGS. 14 and 15 are views showing the mechanism which alternately grips and releases the composite structure at the centre.
Figure 15:
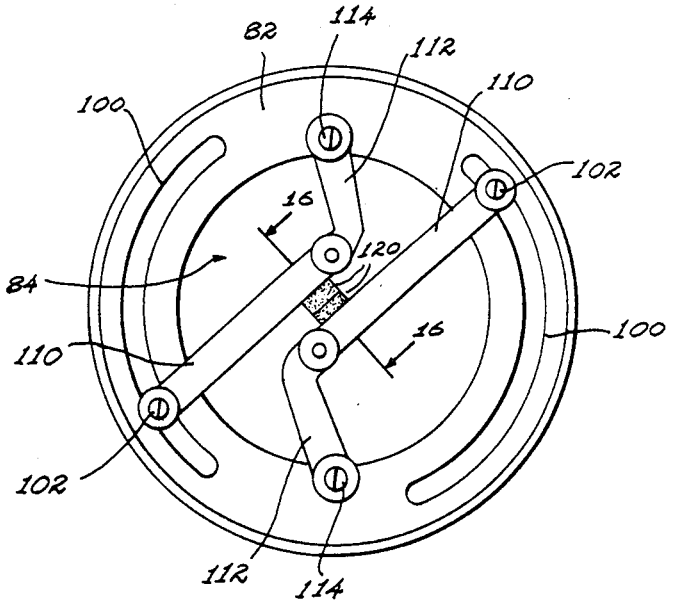

The central gripper 64 includes a pair of rotatable rings 80 and 82 which rotatably support gripping means 84 (see FIGS. 14 and 15). The ring 80 is rotated by means of an electric motor 86 driving the ring 80 through a band 88. The ring 82 is linked by means of a band 90 to a braking or drag device 92 such as a mechanical or friction or magnetic drag device. As will be described the two rings 80 and 82 are joined so that they rotate together but the device 92 applies a resistance to the rotation of the ring 82.

Figure 12:
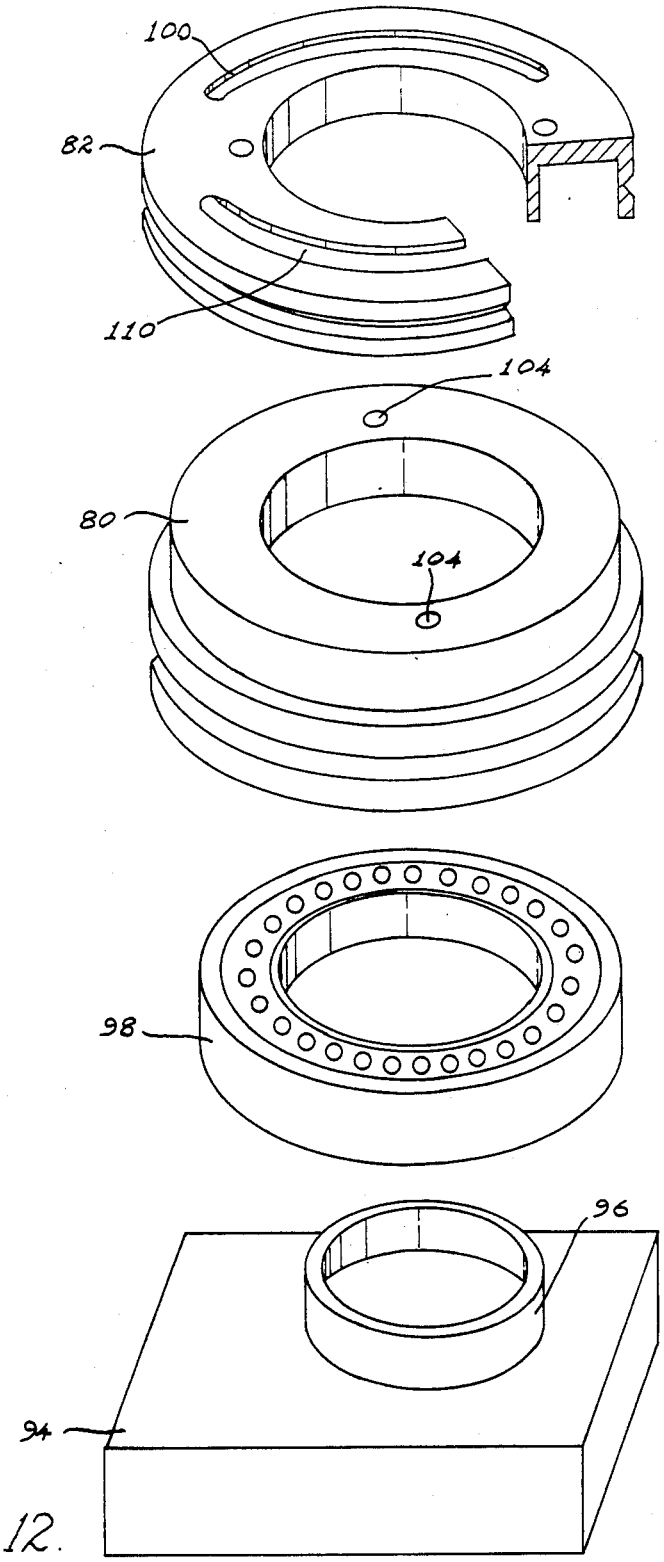
FIG. 12 is an exploded view of the device which grips and rotates the centre of the composite structure relative the ends.
Figure 13:
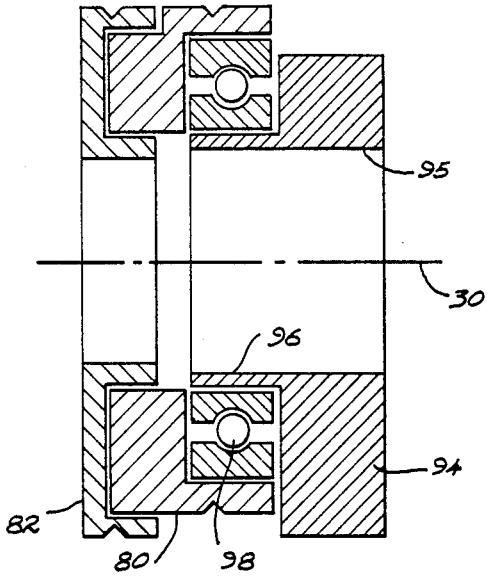
FIG. 13 is a section through the device shown in FIG. 12.
Figure 16:
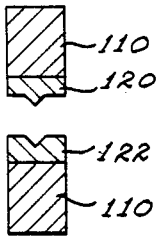
FIG. 16 is a section taken on the line 16—16 of FIG. 15.

As best shown in FIGS. 12 and 13, the two rings 80 and 82 are rotatably supported upon a stationary upright stand 94 in alignment with a hole 95 through the stand. The latter has a ring 96 carrying a ball bearing race 98 which in turn supports the ring 80.

The ring 82 has a pair of opposed curved slots 100 through it extending over about 90° and through these slots extend screws 102 fixed in tapped holes 104 in the ring 80. Because the screws extend through the slots 100, the ring 82 is forced to rotate together with the ring 80 when the screws engage one end of their respective slots. However when the direction of rotation is reversed the screws are initially free to slide around to the other end of the respective slots before the ring 82 is again forced to rotate together with the ring 80. The device 92 which provides the limited resistance to rotation of the ring 82 ensures that the screws 102 are always at the trailing end of their respective slots and so there will always be an approximately 90° slip of rotation of the ring 82 whenever the direction of rotation of the ring 80 is reversed, and thereafter the two rings will rotate together.

This slip of rotation is used to actuate the gripping means 84. The latter comprises an arm 110 pivotally joined to each screw 102 and a further pivoted link 112 pivotally joined at its ends respectively to the ring 82 by means of screw 114 and to the free end of the arm 110. The arms 110 carry male and female grippers 120 and 122 which are designed to grip and trap the structure 30.

When the ring 80 is rotated in an anti-clockwise direction the arms 110 take up one limit position as shown in FIG. 13 with the grippers 120 and 122 closed together to grip the structure 30. Therefore rotation of the rings 80 and 82 by the motor 86 twists up the structure 30 in the manner shown in FIGS. 7 and 8. The motor 86 is provided with means to sense the resulting increasing force of the twisting of the wires 26 and 28 and at a preset force corresponding to the degree of twisting required, the motor is stopped and its direction of rotation reversed. As a result the screws 102 move towards the other ends of the respective slots 100, in FIG. 14 they are approaching this position, and as a result the grippers 120 and 122 open up and release the twisted structure 30.

After the structure 30 has been advanced by the length L (FIG. 7) the direction of rotation of the motor 86 is again reversed and the grippers 60 and 62 closed to repeat the cycle.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A twig pair for forming a branch of an artificial Christmas tree or other decoration, said twig pair formed from a composite structure twisted at the centre of its length relative to its ends, said composite structure having a longitudinal centre line and comprising a sandwich of at least one strip of synthetic plastic sheeting provided between a pair of wires positioned approximately at said longitudinal centre line of said composite structure, said sheeting having longitudinal side edges provided with a very large number of closely spaced transverse cuts creating transverse elements simulating pine needles, the direction of twisting of said composite structure being oppositely oriented on either side of the centre of the length of said composite structure such that the simulated pine needles are inclined towards the ends of the twigs.

2. A twig pair according to claim 1 in which said composite structure comprises two relatively wide strips of synthetic plastic sheeting, a first sheet of a lighter green colour and a second sheet of a darker green colour to simulate the colours of natural pine needles, and a narrow central strip of synthetic plastic sheeting of a brown colour whereby the stem of a natural twig is simulated.

3. A twig pair according to claim 1 in which said composite structure comprises at least two relatively wide strips of synthetic plastic sheeting, and a strip of synthetic plastic sheeting of intermediate width whereby a range of pine needle lengths are simulated; and a narrow central strip of synthetic plastic material whereby the stem of a twig is simulated.

4. A twig pair according to claim 3 wherein said two relatively wide strips are of the same width and wherein for each strip the transverse cuts from one edge of the strip are longer than from the other edge of the same strip, and wherein the two strips are positioned assymetrically in relation to one another with one strip inverted 180° relative the other strip whereby along with said intermediate strip, a varied range of needle lengths is simulated.

5. A twig pair according to claim 1, to be used for forming an artificial Christmas tree branch, said branch comprising a main stem formed by twisting a number of wires around one another length-wise and trapping said twig pairs at the centre of each twig pair length.

6. An artificial twig pair comprising first and second, elongated wires of a length substantially equal to the combined length of the twig pair, a strip of sheeting disposed between the wires and extending substantially over their lengths, the sheeting having longitudinal edges and a relatively large number of relatively closely spaced transverse cuts extending from the edges towards the wires and defining tree needle simulating transverse elements; sections of the first and second wires with the sheeting between them being twisted about themselves in opposite directions from a point spaced from the respective ends of the twig pair so that the transverse elements simulate tree needles which generally point towards the respective ends of the twig pair.

* * * * *